US008667746B1

(12) United States Patent
Francies, III

(10) Patent No.: US 8,667,746 B1
(45) Date of Patent: Mar. 11, 2014

(54) LIFTING ASSEMBLY FOR PRECAST CONCRETE BUILDING PANEL HAVING REDUCED THERMAL CONDUCTIVITY, AND METHOD OF CONSTRUCTING AND USING THE SAME

(76) Inventor: Sidney E. Francies, III, Lithia, FL (US)

( * ) Notice: Subject to any disclaimer, the term of this patent is extended or adjusted under 35 U.S.C. 154(b) by 193 days.

(21) Appl. No.: 13/475,194

(22) Filed: May 18, 2012

Related U.S. Application Data

(60) Provisional application No. 61/488,651, filed on May 20, 2011.

(51) Int. Cl.
*E02D 35/00* (2006.01)
*E04H 13/00* (2006.01)

(52) U.S. Cl.
USPC ..... 52/125.4; 52/122.1; 52/125.2; 52/125.3

(58) Field of Classification Search
USPC ..... 52/125.4, 122.1, 124.2, 125.1, 125.2, 52/125.3, 125.5, 125.6, 698, 700, 712–715
See application file for complete search history.

(56) References Cited

U.S. PATENT DOCUMENTS 8,402,701 B2 * 3/2013 Arteon ..... 52/125.2
2004/0159069 A1 * 8/2004 Hansort ..... 52/698

FOREIGN PATENT DOCUMENTS

WO WO2008/078008 * 7/2008

* cited by examiner

*Primary Examiner* — Mark Wendell
(74) *Attorney, Agent, or Firm* — McGarry Bair PC

(57) ABSTRACT

A building panel comprises 2 parallel slabs separated by a layer of insulation. Each of a pair of planar plate-like lift wings has a 1st and a 2nd lift wing portion. Each of the 1st lift wing portions is penetrated by at least one through opening. A planar plate-like lift head defines a plane of symmetry orthogonal thereto. 1st and 2nd lift head portions are symmetrically disposed on either side of the plane of symmetry. Each lift head portion is penetrated by at least one through opening symmetrically disposed relative to the plane of symmetry. Each lift head portion is penetrated by at least one through opening symmetrically disposed relative to the plane of symmetry. The lift head is attachable to both lift wings when the 1st lift wing portions are orthogonal to the plane of symmetry. The lift head is detachable from both lift wings to eliminate thermal conductivity between the lift wings.

12 Claims, 13 Drawing Sheets

LIFTING ASSEMBLY FOR PRECAST CONCRETE BUILDING PANEL HAVING REDUCED THERMAL CONDUCTIVITY, AND METHOD OF CONSTRUCTING AND USING THE SAME

CROSS-REFERENCE TO RELATED APPLICATION

This application claims the benefit of U.S. provisional application Ser. No. 61/488,651, filed May 20, 2011, which is incorporated herein by reference in its entirety.

BACKGROUND OF THE INVENTION

1. Field of the Invention

The invention relates generally to a lifting assembly for precast concrete insulated building panels having a reduced thermal conductivity. In another aspect, the invention relates to a thermally conductive lifting assembly coupled with a pair of parallel precast concrete slabs separated by a layer of insulation, which can be partially disconnected to eliminate thermal conductivity between the concrete slabs.

2. Description of the Related Art

It is known to utilize concrete building elements, such as wall panels and roof panels, that are pre-cast prior to shipment and installation on a construction project. Frequently, such panels are insulated, with a layer of insulation interposed between two parallel concrete slabs. A building panel can be very heavy and must be removed from a mold, placed on a transporting vehicle, and installed at the construction site as a single piece using cranes, helicopters, and other heavy equipment.

To facilitate the attachment of hooks, cables, chains, and the like for moving such panels, the insulated building panels are fabricated with metallic lifting anchors integrated into the concrete slabs during molding of the slabs. When the concrete has cured, the lifting anchors are partly embedded in the concrete slabs and partly exposed for connecting hooks, cables, chains, and other lifting and moving apparatus.

Known metal lifting devices set into the concrete slabs can be a single element that spans the insulation layer and creates a thermal bridge between the slabs across which heat energy can be transferred. This typically can reduce the insulation rating of the building panel. However, use of such lifting devices is necessary.

A need exists for a lifting assembly, and a method of constructing and using such a lifting assembly, for precast concrete insulated building panels that does not transfer heat energy from one concrete slab to the other.

BRIEF SUMMARY OF THE INVENTION

A precast concrete panel comprises 2 parallel slabs separated by a layer of insulation. Each of a pair of planar plate-like lift wings has a $1^{st}$ and a $2^{nd}$ lift wing portion. Each of the $1^{st}$ lift wing portions is penetrated by at least one through opening. A planar plate-like lift head defines a plane of symmetry orthogonal thereto. $1^{st}$ and $2^{nd}$ lift head portions are symmetrically disposed on either side of the plane of symmetry. Each life head portion is penetrated by at least one through opening symmetrically disposed relative to the plane of symmetry. The lift head is attachable to both lift wings when the $1^{st}$ lift wing portions are orthogonal to the plane of symmetry. The lift head is detachable from both lift wings to eliminate thermal conductivity between the lift wings.

DETAILED DESCRIPTION OF EMBODIMENTS OF THE INVENTION

As may be used herein, the following terms have the associated definitions unless otherwise indicated:

"Axis" means "a real or imaginary straight line about which a three-dimensional body is symmetrical."

"Longitudinal" with respect to a body means "correlating with the axis of a body that is parallel to the longitudinal axis of the assembled precast concrete building panel."

"Plane of symmetry" means "a real or imaginary plane that divides a body such that each side of the body is a mirror reflection of the other."

Figure 1:
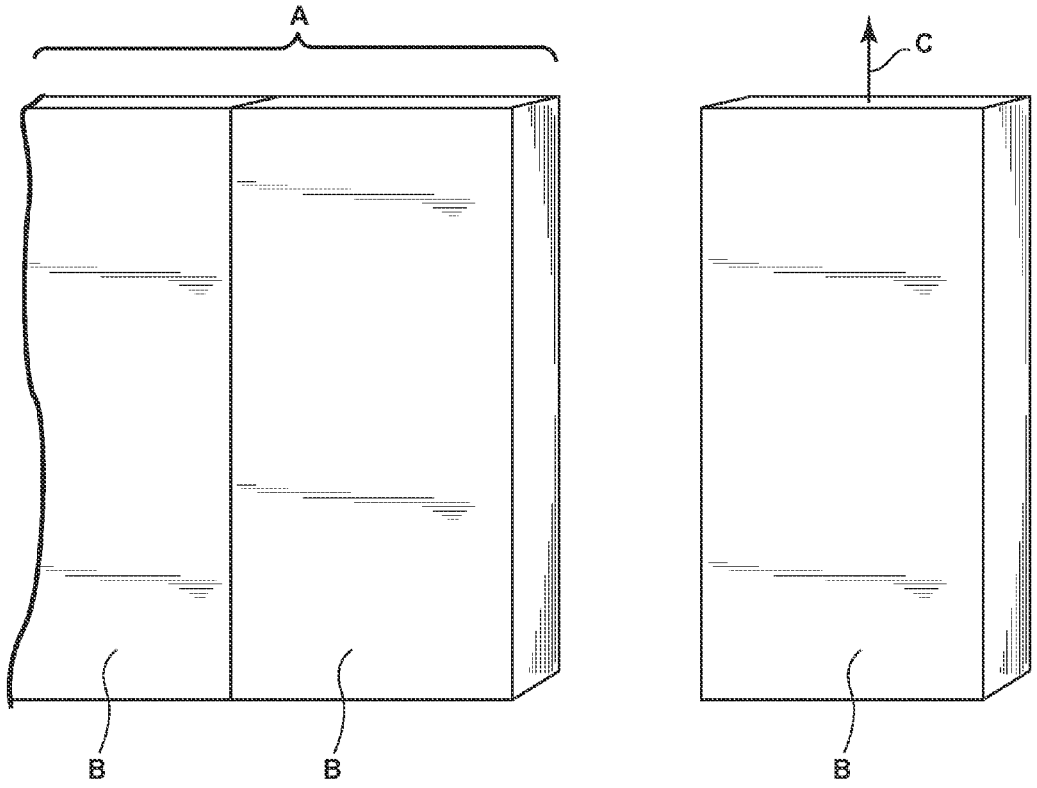
FIG. 1 is a schematic perspective view of the construction of a precast concrete building wall comprising a plurality of individual precast concrete building panels.

Referring to the drawings, FIG. 1 illustrates schematically the erection of a wall A constructed of a plurality of precast concrete building panels B. Each building panel B is lifted into place by a panel lifting apparatus C, such as a crane, a helicopter, and the like. The building panels B are constructed with lifting elements (not shown) that are incorporated into each panel B for coupling with the panel lifting apparatus C.

Figure 2:
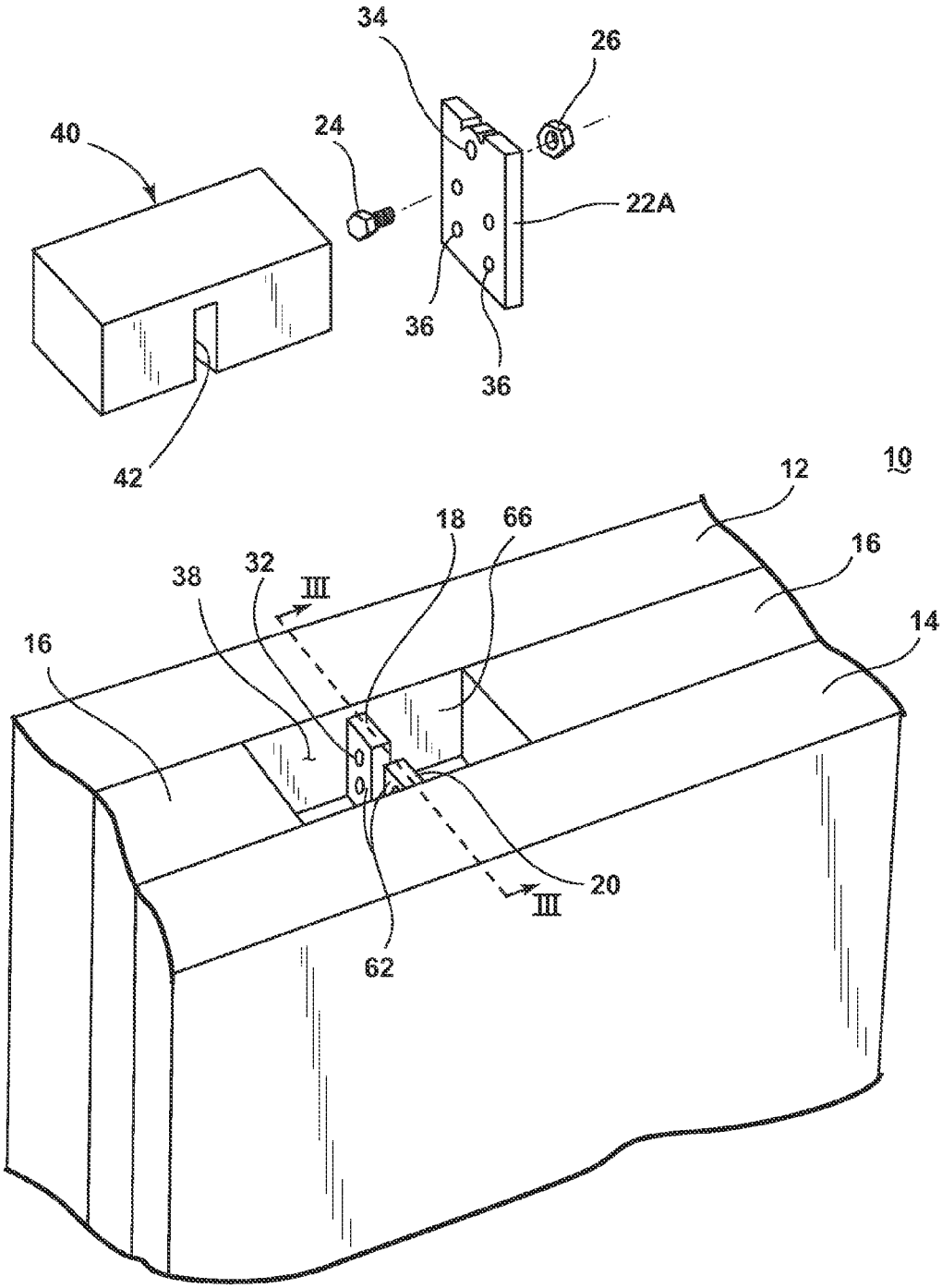
FIG. 2 is an exploded view of a precast concrete insulated building panel, including a lifting assembly according to a first exemplary embodiment of the invention comprising a pair of lift wings partially embedded in concrete slabs, a lift head and an exemplary fastener for temporary attachment to the lift wings, and an insulation plug configured for insertion in a lift head cavity.

As illustrated in FIG. 2, a first precast concrete panel 12 and a second precast concrete panel 14, each characterized by an inward-facing surface 66, are separated by an insulation layer 16 therebetween. A panel erection lifting assembly 10 according to a first exemplary embodiment includes a first lift wing 18 partially embedded in the first precast concrete panel 12, and a second lift wing 20 partially embedded in the second precast concrete panel 14. It can be seen that the lift wings 18, 20 extend coplanarly from the concrete panels 12, 14, but do not touch.

Figure 3:
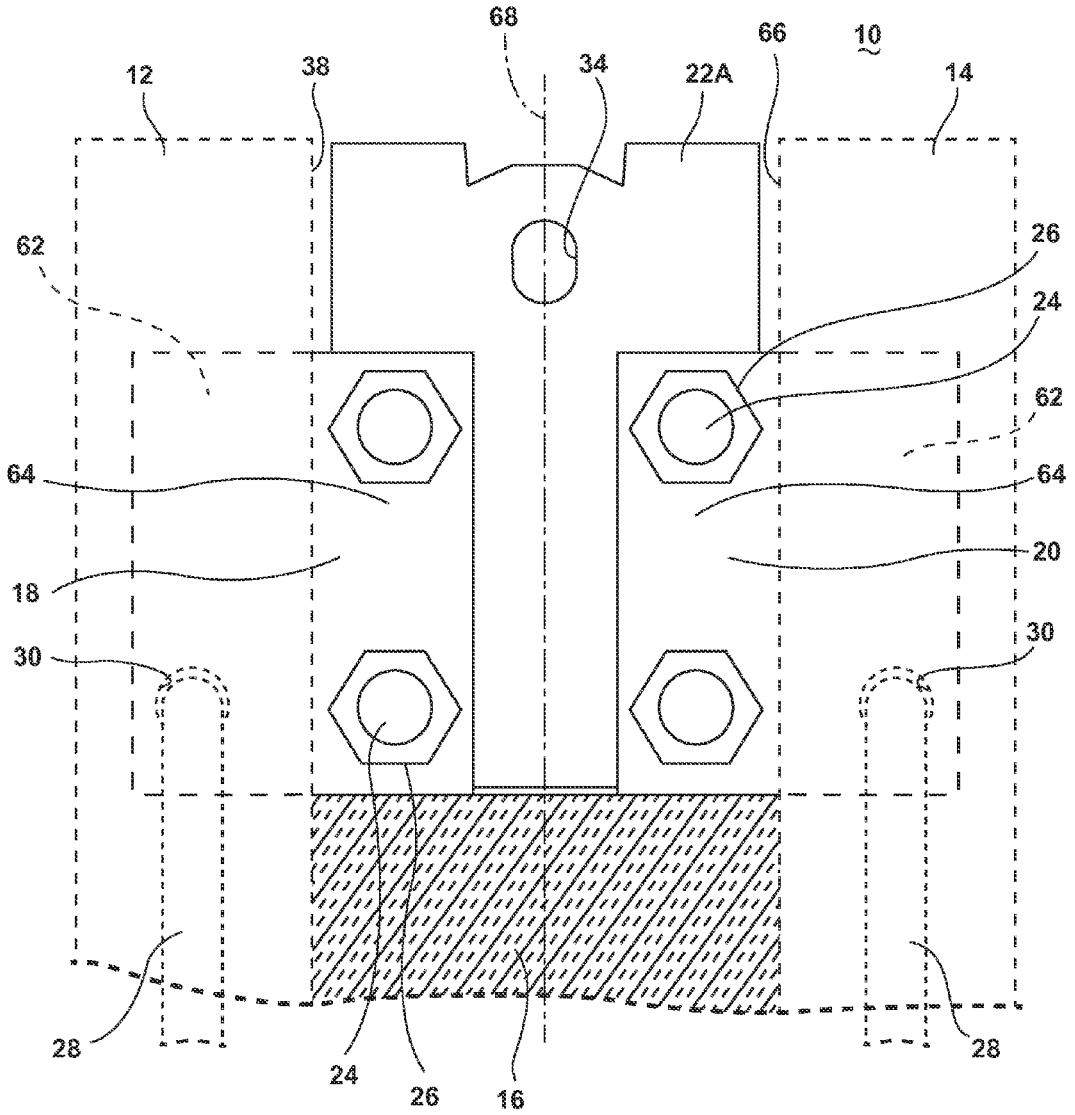
FIG. 3 is a sectional elevation view of the lifting assembly attached to a precast concrete insulated building panel comprising a lift head, and a pair of lift wings with tension bars partially embedded in concrete slabs, taken along view line 3-3 of FIG. 2.
Figure 4:
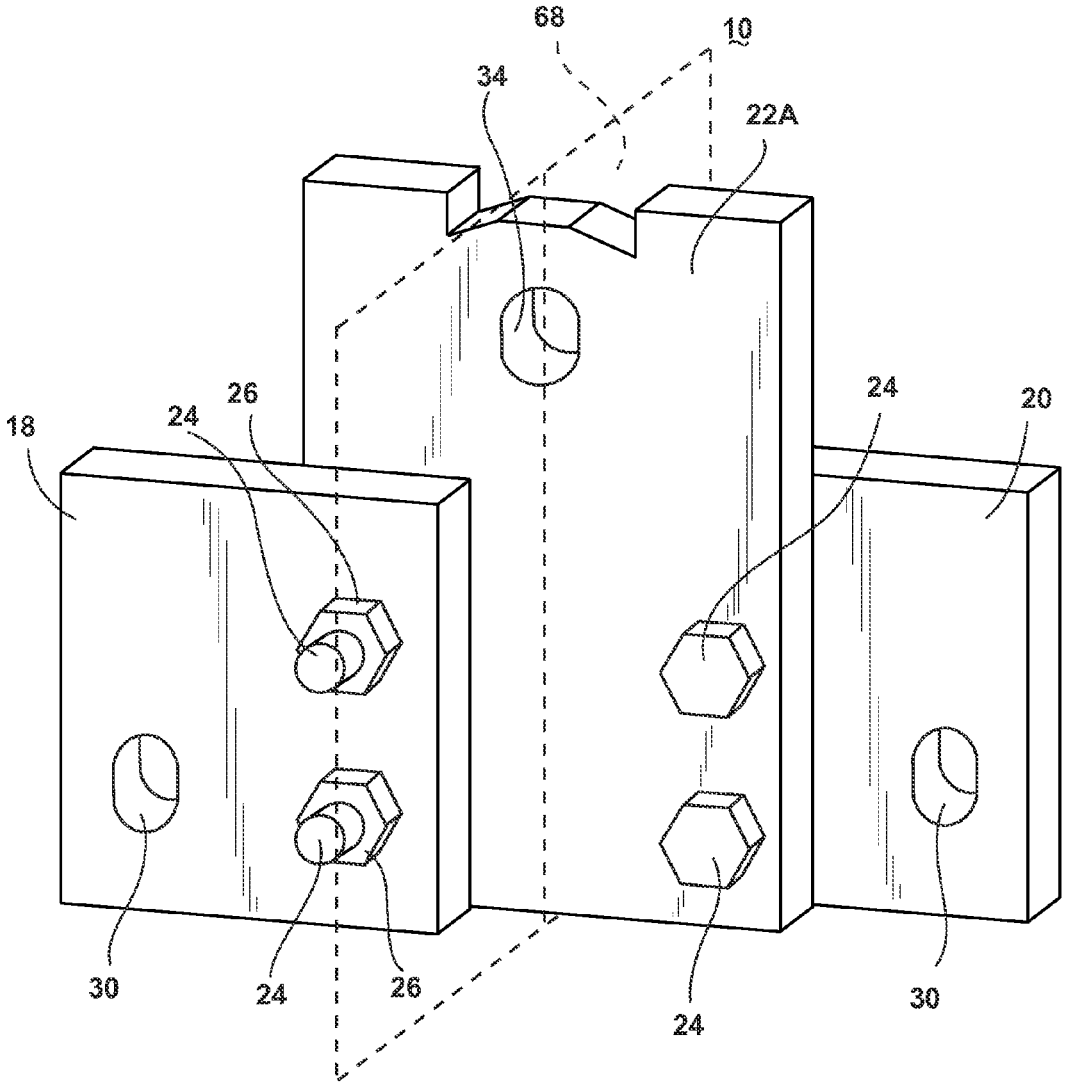
FIG. 4 is a perspective view of a second exemplary embodiment of the invention bisected by a plane of symmetry.
Figure 6:
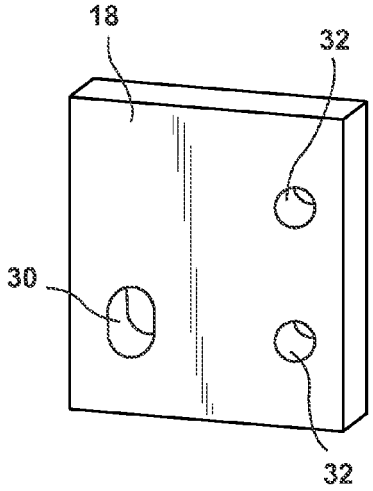
FIG. 6 is a perspective view of a lift wing as illustrated in FIGS. 2, 3 & 4.

Referring also to FIGS. 3, 4 & 6, the lift wings 18, 20 comprise a pair of rectangular plate-like bodies with openings extending therethrough. Each lift wing 18, 20 is characterized longitudinally into a first portion 62 and a second portion 64. The first portion 62 is intended to be embedded in a concrete slab 12, 14, and includes a tension bar opening 30, such as a circular or oval shaped opening, for insertion of a tension bar 28 therethrough as hereinafter described. The second portion 64 is intended to extend beyond the inward-facing surface 66 of each concrete slab 12, 14, and includes bolt openings 32 for insertion of lift bolts 24 as hereinafter described.

The lift wings 18, 20 are identical, and are oriented relative to each concrete slab 12, 14 as described above. The lift wings 18, 20 can be fabricated of a material, such as steel, or iron, having sufficient strength and durability for the purposes described herein.

Figure 5A:
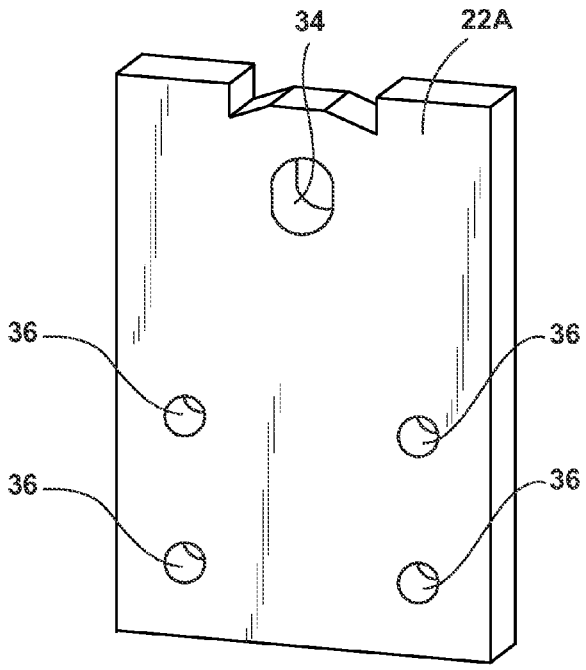
FIGS. 5A & B are perspective views of a lift head according to two exemplary alternate embodiments of the invention.

Referring again to FIG. 2, a first embodiment lift head 22A is illustrated comprising a generally rectangular plate-like body with openings extending therethrough. As illustrated in FIGS. 3 & 4, the lift head 22A can be characterized by a plane of symmetry 68. As illustrated also in FIG. 5A, the openings include a lift head opening 34 bisected by the plane of symmetry 68, and two pair of bolt openings 36 distributed symmetrically about the plane of symmetry 68. The lifting capacity of the lift head 22A will be defined by the type and grade of material, i.e. steel, iron, and the like, the dimensions of the lift head 22A, the strength of the lift bolts 24, the number of bolts 24, material strength in the region adjoining the lift head opening 34, appropriate factors of safety, and the like. Thus, a greater or lesser number of lift bolts 24 and through openings 32, 36 may be utilized.

FIGS. 3 & 4 illustrate the lift head 22A bolted to the lift wings 18, 20 in two alternative configurations. In FIG. 3, the lift wings 18, 20 are coplanar, and the lift head 22A is bolted along one side of the lift wings 18, 20. With the lift head 22A removed, the lift wings 18, 20 will be spaced away from one another, as illustrated in FIG. 2. In FIG. 4, the lift wings 18, 20 are offset by a distance somewhat greater than the thickness of the lift head 22A. Thus, the lift head 22A can be inserted between the lift wings 18, 20 so that the lift head bolt openings 36 are aligned with the lift wing bolt openings 32, enabling installation of lift bolts 24 therethrough. With the lift head 22A removed, the lift wings 18, 20 will be laterally spaced away from one another, as illustrated in FIG. 8B.

Figure 5B:
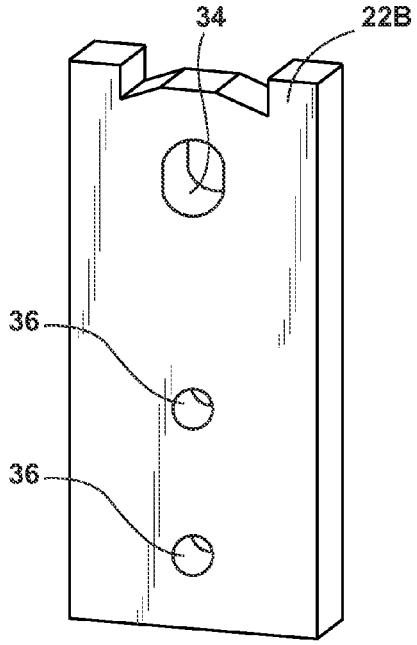

Referring now to FIG. 5B, a second embodiment lift head 22B is illustrated. The lift head 22B is essentially identical to the lift head 22A except that a single pair of bolt openings 36 are disposed longitudinally with the lift head opening 34 so that the bolt openings 36 and lift head opening 34 are bisected by the plane of symmetry 68. It may be understood that the lift head 22B may have a lifting capacity less than that of the lift head 22A. Nevertheless, the lifting capacity of the lift head 22B will be defined by the type and grade of material, i.e. steel, iron, and the like, the dimensions of the lift head 22B, the strength of the bolts 24, the number of bolts, material strength in the region adjoining the lift head opening 34, appropriate factors of safety, and the like.

High strength fasteners, such as high strength threaded bolts and nuts are utilized to attach the lift head 22 to the lift wings 18, 20. As discussed above with respect to the lift head 22A, the lift wings 18, 20 can be attached to the lift head 22A either coplanarly along one side of the lift head 22A or on either side of the lift head 22A. With respect to the lift head 22B, the lift wings 18, 20 are attached to the lift head 22B on either side with each lift bolt 24 installed through a bolt opening 32 in each lift wing 18, 20 and a bolt opening 36 in the lift head 22B. Once the lift bolts 24 are installed and the nuts 26 tightened, the lift head 22B will be securely fastened to the lift wings 18, 20.

Figure 7A:
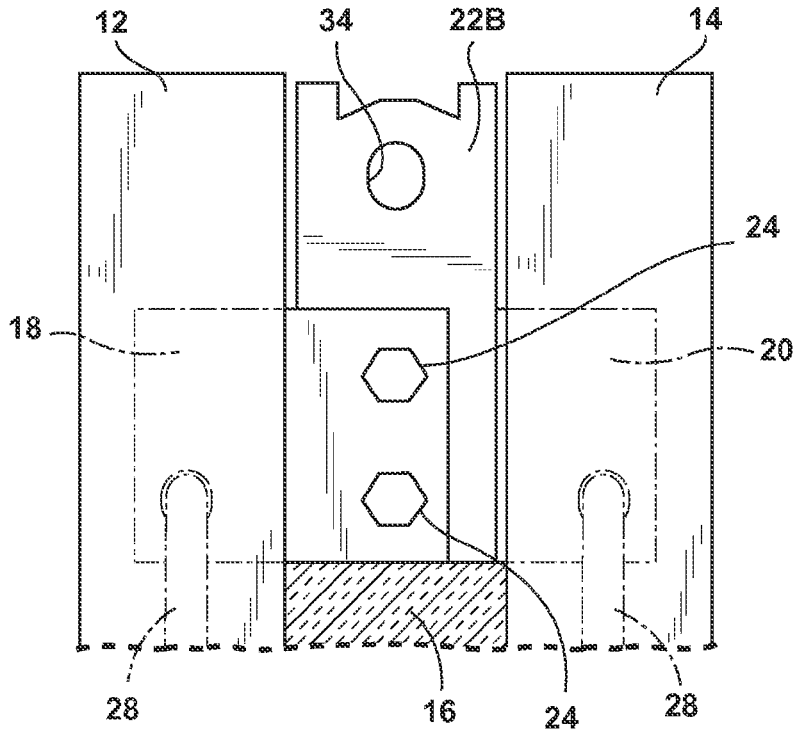
FIGS. 7A & B are a front elevation view and a top plan view, respectively, of a precast concrete insulated building panel incorporating a third exemplary embodiment of the invention.
Figure 7B:
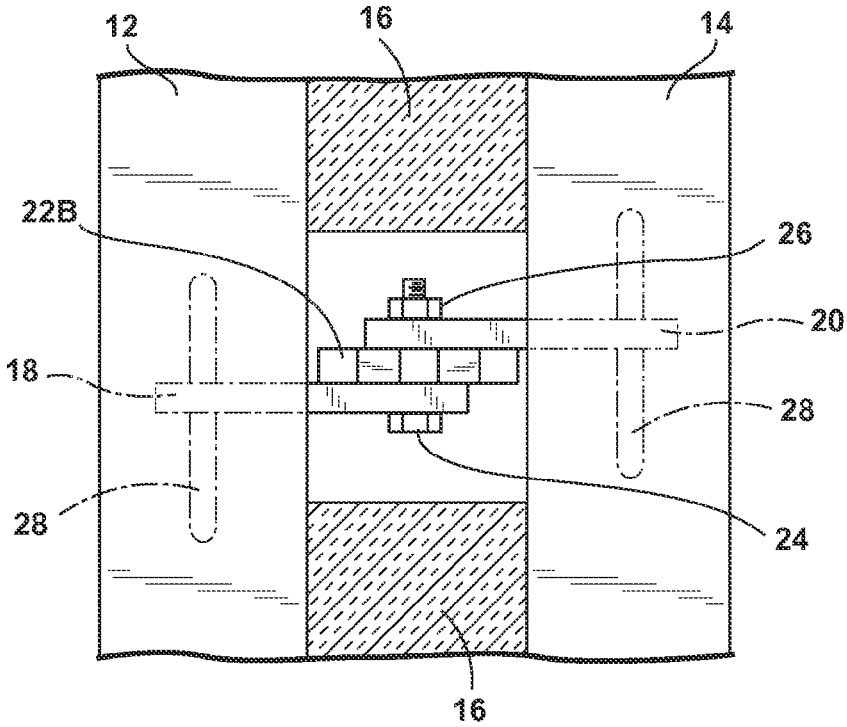

FIGS. 7A & B and 8A & B illustrate a precast concrete building panel with a panel erection lifting assembly utilizing the lift head 22B. FIG. 7A illustrates precast concrete panels 12, 14 sandwiching a layer of insulation 16. A pair of lift wings 18, 20 extend inwardly from each panel 12, 14 into a lift head cavity 38. The lift wings 18, 20 are offset by a distance somewhat greater than the thickness of the lift head 22B. Thus, the lift head 22B can be inserted between the lift wings 18, 20, and coupled together, such as with a bolted or other threaded connection. FIG. 7B illustrates the configuration of the lift wings 18, 20 and the lift head 22B bolted together utilizing a single bolt 24 extending through the lift wings 18, 20 and lift head 22B.

Figure 8A:
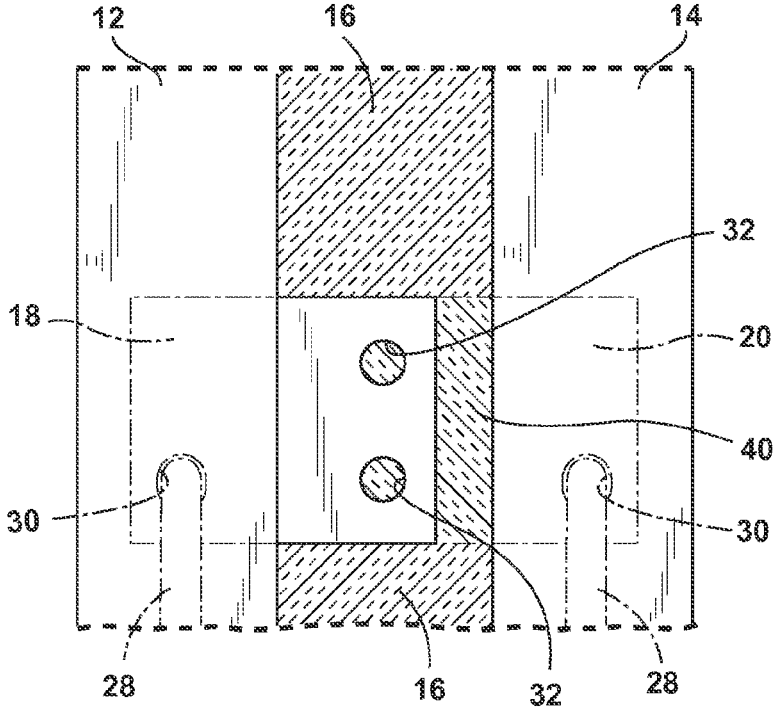
FIGS. 8A & B are a front elevation view and a top plan view, respectively, of the lifting assembly illustrated in FIGS. 7A & B with the lift head removed.
Figure 8B:
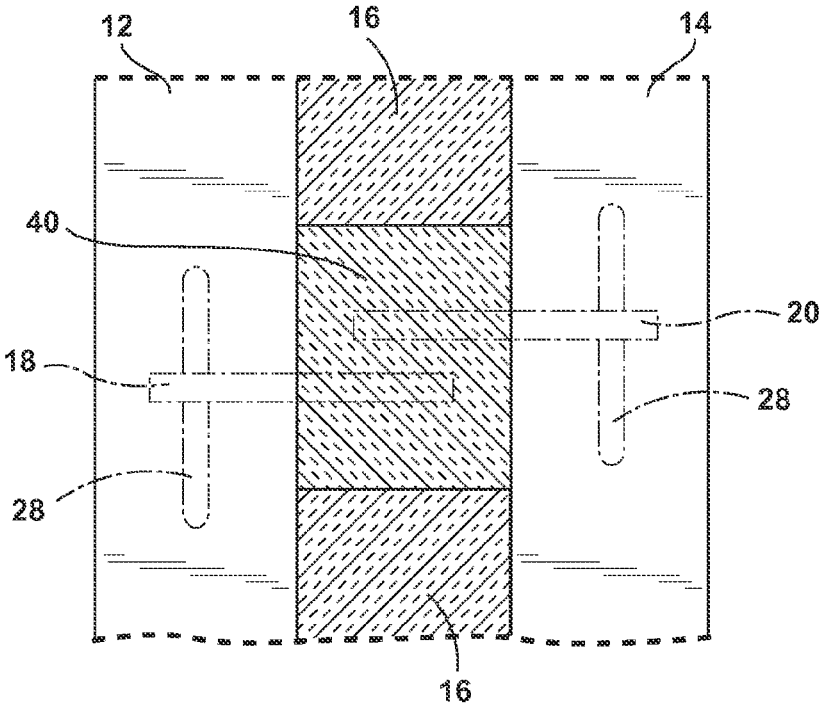

FIG. 8A illustrates the precast concrete building panel and lifting assembly illustrated in FIG. 7A, with the lift head removed. As can be seen from FIG. 8B, removal of the lift head 22B from the lift wings 18, 20 leaves a space between the lift wings 18, 20 that eliminates thermal conductivity between the concrete slabs 12, 14. The lift head cavity 38 can then be filled with an insulation plug 40, completely eliminating any thermal conductivity between the concrete slabs 12, 14.

Figure 9:
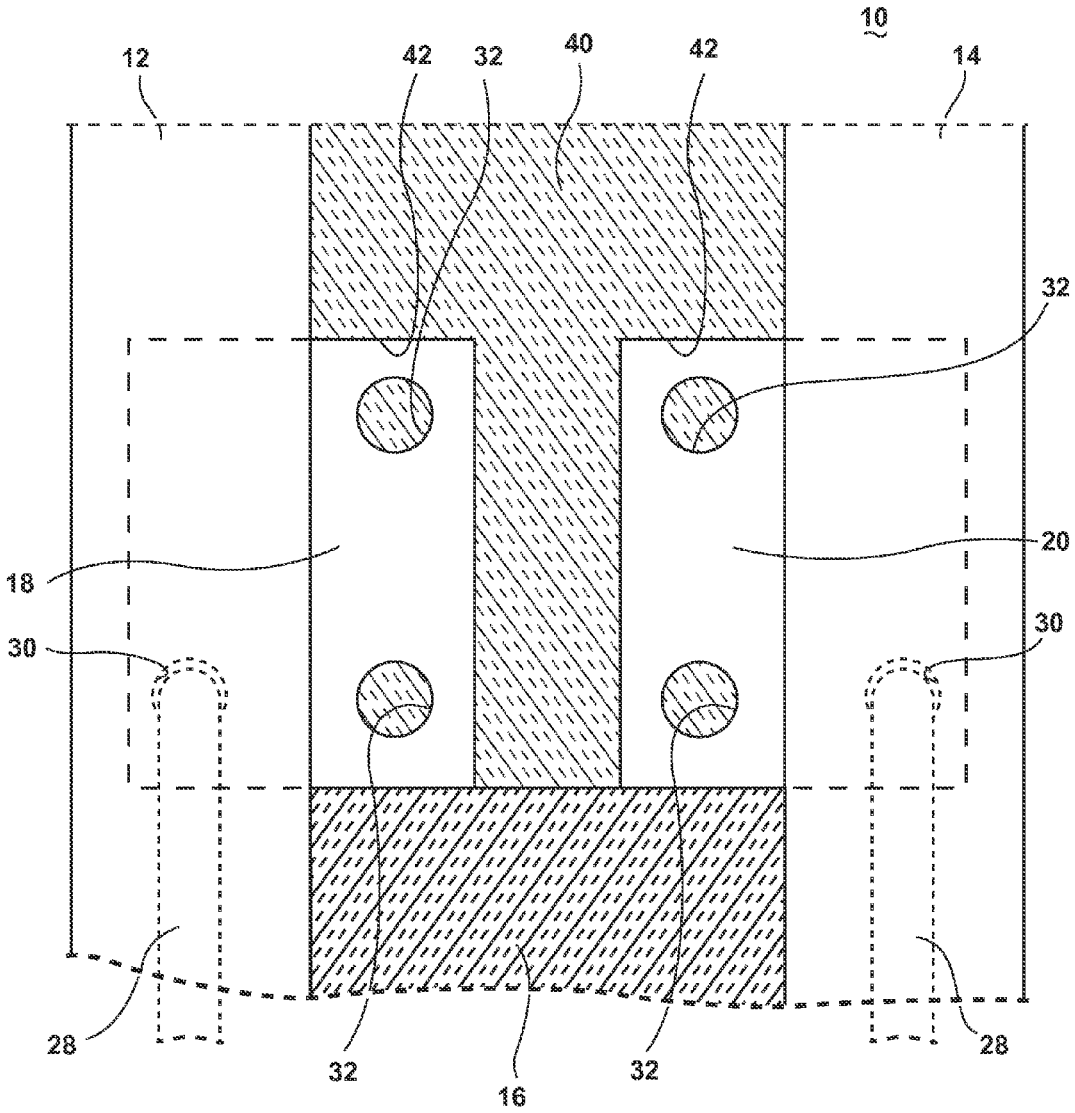
FIG. 9 is an elevation view of the precast concrete insulated building panel and lifting assembly illustrated in FIG. 3 with the lift head removed and the insulation insert in the lift head cavity.

FIG. 9 illustrates the precast concrete building panel and lifting assembly illustrated in FIG. 3, with the lift head 22A removed. As can be seen from FIG. 9, removal of the lift head 22A from the lift wings 18, 20 leaves a space between the lift wings 18, 20. The lift head cavity 38 can be filled with an insulation plug 40, completely eliminating any thermal conductivity.

Figure 10A:
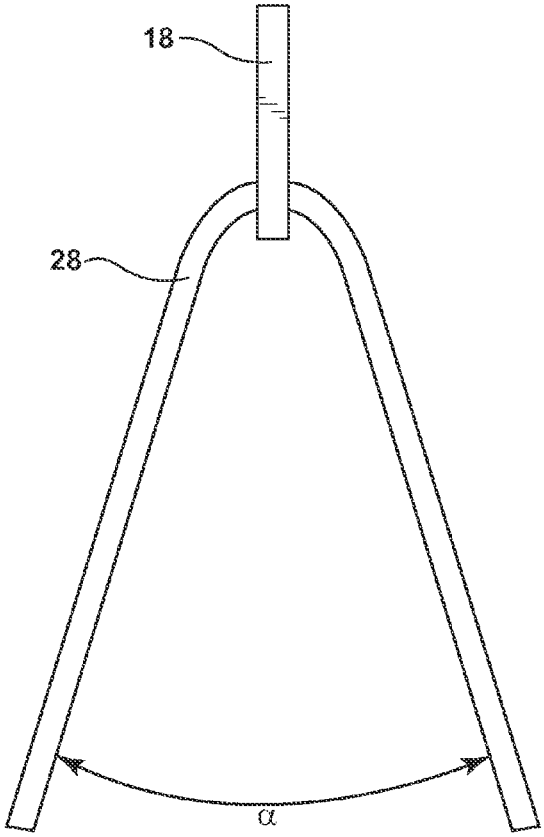
FIGS. 10A & B are a side elevation view and a front elevation view, respectively, of a lift wing coupled with a first embodiment tension bar as illustrated in FIGS. 3 & 9.
Figure 10B:
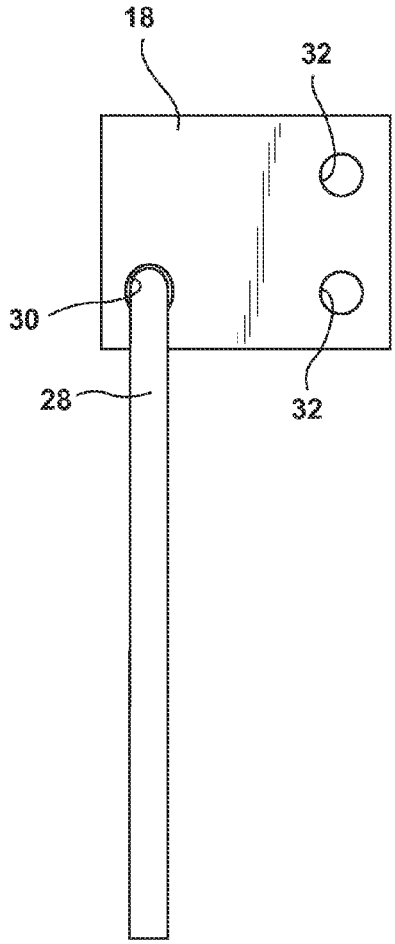

Referring now to FIG. 10A, a tension bar 28 is illustrated attached to a lift wing 18 through a tension bar opening 30. The tension bar 28 is a somewhat inverse V-shaped member defining an angle $\alpha$. The tension bar 28 is encased within a concrete slab 12, 14 to enhance the resistance of the lift wings 18, 20 to pullout during lifting that can occur as a consequence of the relatively low tensile strength of concrete. The divergence of the tension bar legs by the angle $\alpha$ can enable the higher compressive strength of the concrete to be utilized to prevent pullout of the tension bar 28 and lift wings 18, 20 in the concrete during lifting of the building panel.

Figure 11A:
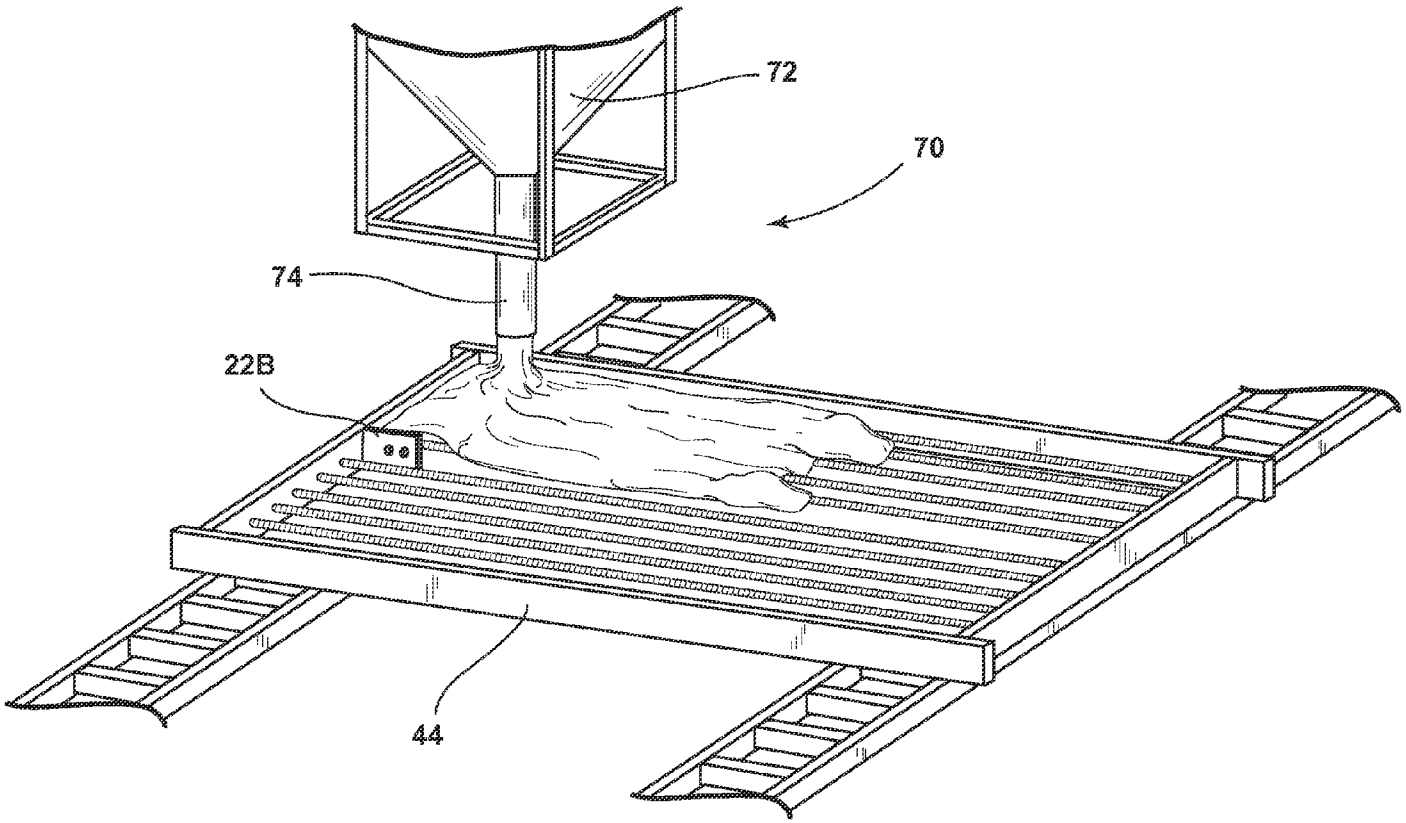
FIG. 11A is a perspective view of an exemplary precast concrete panel forming apparatus.

A precast concrete building panel can be constructed to accommodate the panel erection lifting assembly 10 in a generally known precast concrete panel forming apparatus 70, such as illustrated in FIG. 11A. The panel forming apparatus 70 can include a panel form 44, or "pan," into which fresh concrete can be placed. A concrete bucket 72 having a bottom discharge gate 74 can be movably suspended from a gantry system (not shown) for placement of fresh concrete into the panel form 44. The bucket 72 can be moved along the gantry system to a selected area above the form 44, into which fresh concrete can be placed from the bucket 72.

Figure 11B:
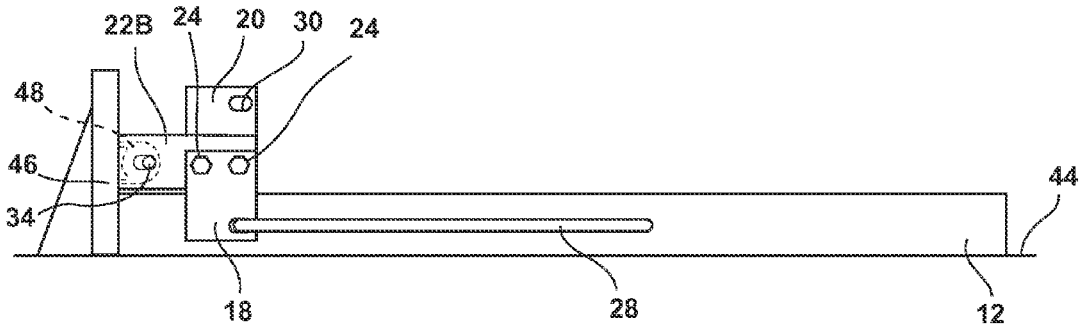
FIGS. 11B, C & D are schematic side elevation views of the principal steps in the construction of a precast concrete insulated building panel incorporating the lifting assembly of FIGS. 7 & 8, utilizing the exemplary precast concrete panel forming apparatus illustrated in FIG. 11A.

Referring to FIG. 11B, a precast concrete building panel can be constructed in the panel form 44 including a lift head bracket assembly 46. The lift head bracket assembly 46 can be adapted for temporary immovable attachment of a lift head 22 thereto. This enables the lift head 22 to be fixed in place relative to the concrete slabs 12, 14, the insulation 16, and the lift wings 18, 20 to ensure that the finished building panel can be properly lifted and installed.

Figure 12:
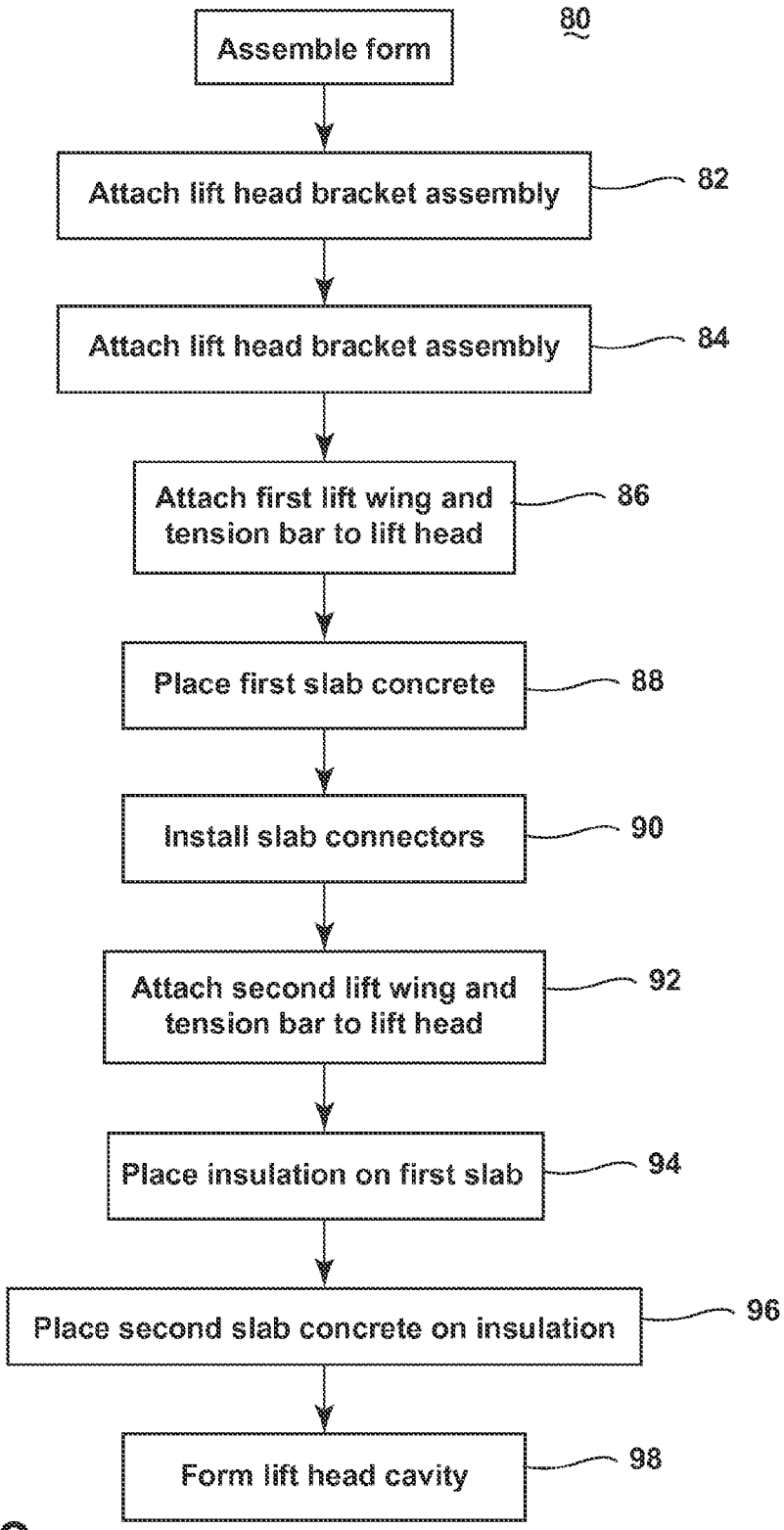
FIG. 12 is a flow chart of steps taken during an exemplary method of constructing a precast concrete insulated building panel incorporating the lifting assembly of FIGS. 7 & 8.

A method of constructing a precast concrete building panel is illustrated in FIG. 12. The first step 80 is to assemble the panel form 44 and the second step 82 is to attach the lift head bracket assembly 46 to the form 44. The lift head 22 can then be attached 84 to the bracket assembly 46.

The first lift wing 18 including the tension bar 28 can be bolted 86 to the lift head 22 so that the first portion 62 of the lift wing 18 and the tension bar 28 are suitably positioned relative to the first concrete slab 12. Fresh concrete is then placed 88 in the concrete panel form 44 to a level somewhat below the lift head 22. The concrete can be cast against the lift head bracket assembly 46, forming the top edge of the first concrete slab 12. The first portion 62 and tension bar 28 will be embedded in the first concrete slab 12, the second portion 64 of the first lift wing 18 extending away from the first concrete slab 12. Before the concrete cures, a plurality of high-strength concrete slab connectors (not shown) can be installed 90 in the concrete slab 12 to hold the concrete slabs 12, 14 together. The connectors should have suitable strength and durability, be non-corrosive, and have low thermal conductivity. An example of such a connector is the THERMO-MASS® fiber composite connector manufactured by Thermomass of Boone, Iowa.

Figure 11C:
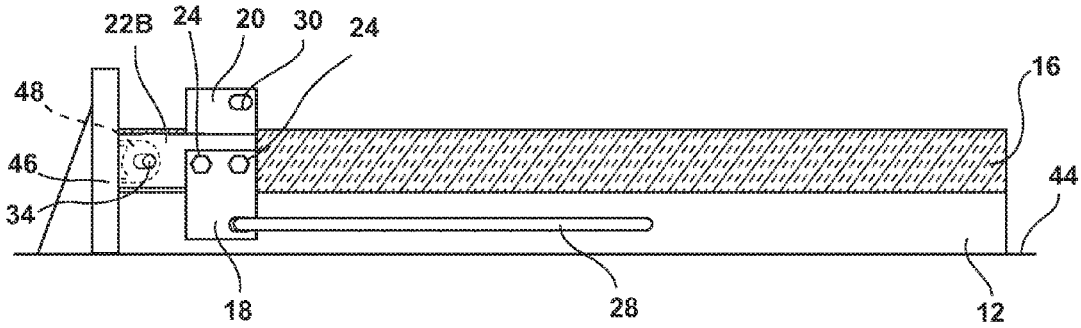

While the concrete cures, or at some time thereafter, the second portion 64 of the second lift wing 20 can be bolted 92 to the lift head 22 so that the first portion 62 of the second lift wing 20 and the tension bar 28 will be suitably positioned relative to the second concrete slab 14. As illustrated in FIG. 11B, the lift head 22B and lift wing bolting configuration shown in FIGS. 5B, 7 & 8 are utilized. As illustrated in FIG. 11C, a layer of insulation 16 can then be installed 94 in contact with the first concrete slab 12 to extend somewhat above the lift head 22B so that the concrete slabs 12, 14 are symmetrically disposed relative to the lift head 22B and plane of symmetry 68. Insulation, or other suitable material, can be utilized to form the lift head cavity 38 during placement of the concrete for the second slab 14.

Figure 11D:
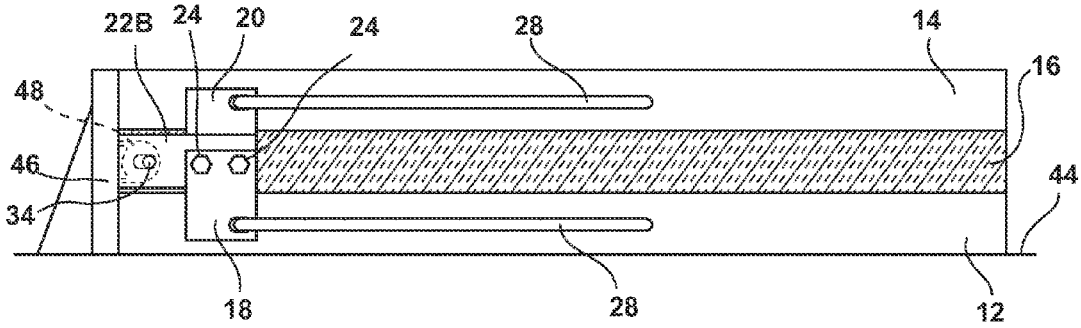

As illustrated in FIG. 11D, fresh concrete is placed 96 in the concrete panel form 44 in contact with the layer of insulation 16 to construct the second concrete slab 14 parallel to the first concrete slab 12 so that the first lift wing portion 62 of the second lift wing 20 and the tension bar 28 are embedded in the second concrete slab 14, the second lift wing portion 64 extending away from the second concrete slab 14. The concrete slab connectors can extend through the insulation 16 and into the concrete slab 14. The concrete forming the second slab 14 is then allowed to cure.

The lift head cavity 38 about the lift head 22 and lift wings 18, 20 can then be formed 98 by removing the insulation to expose the lift head 22 and lift wings 18, 20. The lift head cavity 38 enables access to the lift bolts 24 and lift nuts 26 for removal of the bolts 24, nuts 26, and lift head 22 after the panel has been placed at the construction site.

The finished building panel can be lifted and moved by a suitable panel erection apparatus (not shown) attached to the lift head opening 34. When the building panel has been installed in place, and the panel erection apparatus has been detached from the lift head 22, the lift head 22 can be unbolted from the lift wings 18, 20. The lift head 22 may be reused for another building panel. After the lift head 22 has been removed, the lift head cavity 38 can be filled with an insulation plug 40, thereby filling the space between the first and second slabs 12, 14 entirely with insulation. As described above, the lift wings 18, 20 will be separated, thereby eliminating thermal conductivity between the slabs 12, 14, and the building panel will be fully insulated.

Figure 13A:
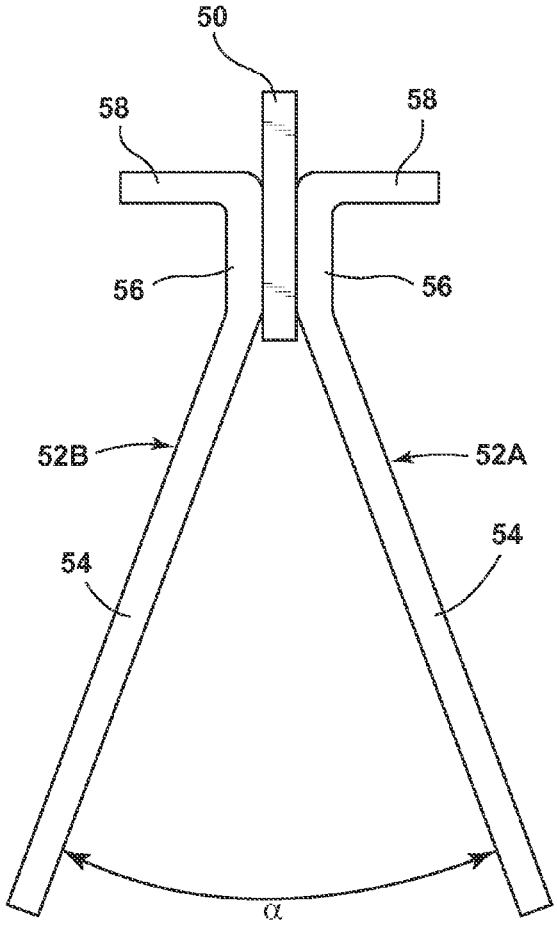
FIGS. 13A & B are a side elevation view and a front elevation view, respectively, of a lift wing coupled with a second embodiment tension bar.
Figure 13B:
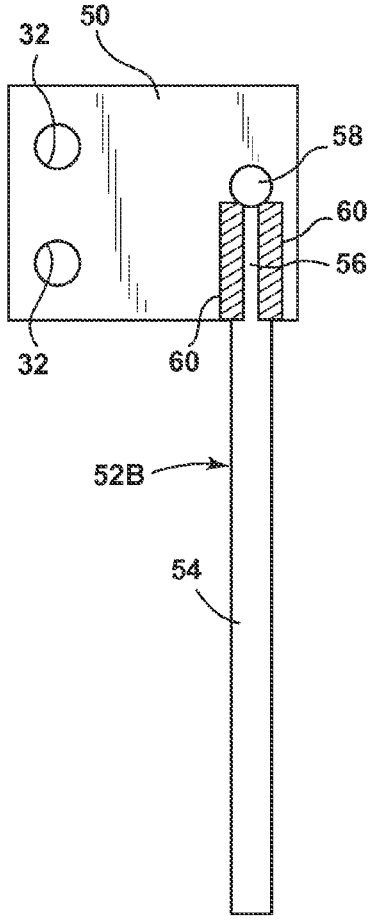

Referring now to FIGS. 13A & B, a second embodiment tension bar 52 is illustrated welded to a second embodiment lift wing 50. The tension bar 52 comprises a pair of identical tension legs 54 transitioning to a weld section 56, in turn transitioning to a bent shear return 58. Each tension bar 52 is welded to the lift wing 50 by a suitable weld 60 extending along the weld section 56. The attachment of the tension bar 52 to the lift wing 50 can occur along the first lift wing portion 62. The tension legs 54 can define an angle $\alpha$, as described previously herein. The bent shear return 58 can increase the pullout strength of the lift wing 50 relative to a tension bar 52 without the bent shear return 58.

The lift wings 18, 20 must be carefully aligned during construction of the precast concrete insulated building panel to ensure proper alignment of the bolt openings 32 with the bolt openings 36. The method described herein, in which the lift head 22 is attached to the panel form 44 and the lift wings 18, 20 are attached to the lift head 22 during construction of the panel can ensure that the lift head and lift wings are properly aligned. The panel erection lifting assembly 10 can readily lift, move, and place precast concrete insulated building panels while maintaining an optimally reduced thermal conductivity across the precast concrete slabs 12, 14. The lift head 22 can be readily removed, thereby severing the thermal conductivity bridge between the lift wings 18, 20. The lift head 22 can be re-utilized after separation from the lift wings 18, 20, providing savings in equipment costs. Although a precast concrete insulated building panel utilizing a single lifting assembly 10 has been described and illustrated herein, two or more lift assemblies may be utilized for large dimension and/or high weight building panels.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A lifting assembly for an insulated panel comprising a pair of precast concrete slabs, said slabs in parallel spaced disposition having an interposed layer of insulation, said lifting assembly comprising:

a pair of planar plate-like lift wings, each planar plate-like lift wing characterized by a first lift wing portion and a second lift wing portion, each first lift wing portion penetrated by at least one lift wing-bounded through opening; and a planar plate-like lift head defining an orthogonally-disposed longitudinal plane of symmetry, and characterized by a first lift head portion and a second lift head portion symmetrically disposed on either side of said longitudinal plane of symmetry, said first and second lift head portions each penetrated by at least one lift head-bounded through opening, said bounded through openings symmetrically disposed relative to said longitudinal plane of symmetry;

wherein said pair of first lift wing portions and said pair of second lift wing portions are orthogonal to said longitudinal plane of symmetry;

wherein said planar plate-like lift head is concurrently attachable to said first planar plate-like lift wing and said second planar plate-like lift wing when said first lift wing portions are orthogonal to said longitudinal plane of symmetry; and wherein said planar plate-like head is detachable from said first planar plate-like lift wing and said second planar plate-like lift wing to eliminate thermal conductivity between said first planar plate-like lift wing and said second planar plate-like lift wing.

2. A lifting assembly in accordance with claim 1 wherein said planar plate-like lift wings are identical.

3. A lifting assembly in accordance with claim 1 wherein each lift wing is immovably embeddable in a precast concrete slab.

4. A lifting assembly in accordance with claim 1 wherein said first lift wing portion is penetrated by two lift wing-bounded through openings.

5. A lifting assembly in accordance with claim 1 wherein said planar plate-like lift head is penetrated by either two lift head-bounded through openings or four lift head-bounded through openings.

6. A lifting assembly in accordance with claim 1 wherein either said first lift wing portion of each lift wing is disposed along a single surface of said planar plate-like lift head, or said first lift wing portion of said first planar plate-like lift wing is disposed along a first surface of said planar plate-like lift head and said first lift wing portion of said second planar plate-like lift wing is disposed along a second surface of said planar plate-like lift head.

7. A lifting assembly in accordance with claim 1 wherein said second lift wing portion further comprises a tension bar-bounded through opening for insertion of a tension bar therethrough.

8. A lifting assembly in accordance with claim 1, and further including a clearance notch in said lift head symmetrically disposed relative to said coupling opening.

9. A lifting assembly in accordance with claim 1 wherein said second lift wing portion further comprises a tension bar coupled therewith.

10. A lifting assembly in accordance with claim 1 wherein said first lift wing portion of said first planar platelike lift wing is parallel to and displaced from said first lift wing portion of said second planar platelike lift wing.

11. A lifting assembly for an insulated panel comprising a pair of precast concrete slabs, said slabs in parallel spaced disposition having an interposed layer of insulation, said lifting assembly comprising:

a pair of plate-like lift wings each lift wing characterized by a first lift wing portion and a second lift wing portion, said first lift wing portion penetrated by at least one lift wing through opening; and a plate-like lift head characterized by a first lift head portion and a second lift head portion symmetrically disposed on either side of a longitudinal plane of symmetry, said lift head portions each penetrated by at least one lift head through opening symmetrically disposed relative to said longitudinal plane of symmetry, said lift head penetrated by a coupling opening bisected by said longitudinal plane of symmetry;

wherein said second lift wing portions can be embedded in a first one and a second one of a pair of precast concrete slabs so that said first lift wing portions extend away from a first one and a second one of a pair of precast concrete slabs;

wherein said first lift wing portion of said first lift wing is parallel to and displaced from said first lift wing portion of said second lift wing when a pair of precast concrete slabs are assembled into an insulated panel;

wherein said lift head can be attached to said first lift wing and said second lift wing by at least one removable threaded fastener passing through said at least one first lift wing through opening, said at least one second lift wing through opening, and said at least one lift head through opening, so that a lifting apparatus can be coupled with said coupling opening to lift an insulated panel; and wherein thermal conductivity between a first precast concrete slab and said second precast concrete slab assembled into an insulated panel is eliminated when said lift head is detached from said first lift wing and said second lift wing, said lift head is attachable to said pair of lift wings.

12. A lifting assembly for an insulated panel comprising a pair of precast concrete slabs, said slabs in parallel spaced disposition having an interposed layer of insulation, said lifting assembly comprising:

a pair of plate-like lift wings each lift wing characterized by a first lift wing portion and a second lift wing portion, said first lift wing portion penetrated by at least one lift wing through opening; and a plate-like lift head penetrated by either two lift head through openings or four lift head through openings, characterized by a first lift head portion and a second lift head portion symmetrically disposed on either side of a longitudinal plane of symmetry, said lift head portions each penetrated by at least one lift head through opening symmetrically disposed relative to said longitudinal plane of symmetry, said lift head penetrated by a coupling opening bisected by said longitudinal plane of symmetry;

wherein said second lift wing portions can be embedded in a first one and a second one of a pair of precast concrete slabs so that said first lift wing portions extend away from a first one and a second one of a pair of precast concrete slabs;

wherein said first lift wing portion of said first lift wing is parallel to and displaced from said first lift wing portion of said second lift wing when a pair of precast concrete slabs are assembled into an insulated panel;

wherein said lift head can be attached to said first lift wing and said second lift wing so that a lifting apparatus can be coupled with said coupling opening to lift an insulated panel; and wherein thermal conductivity between a first precast concrete slab and said second precast concrete slab assembled into an insulated panel is eliminated when said lift head is detached from said first lift wing and said second lift wing.

* * * * *